US010792202B2

(12) United States Patent
Williams

(10) Patent No.: US 10,792,202 B2
(45) Date of Patent: Oct. 6, 2020

(54) HOSPITAL BED ASSEMBLY

(71) Applicant: Rubie Williams, Blair, SC (US)

(72) Inventor: Rubie Williams, Blair, SC (US)

( * ) Notice: Subject to any disclaimer, the term of this patent is extended or adjusted under 35 U.S.C. 154(b) by 549 days.

(21) Appl. No.: 15/672,839

(22) Filed: Aug. 9, 2017

(65) Prior Publication Data

US 2019/0046378 A1 Feb. 14, 2019

(51) Int. Cl.
*A61G 7/02* (2006.01)
*A61G 9/00* (2006.01)
*A61G 7/015* (2006.01)

(52) U.S. Cl.
CPC ..... *A61G 7/02* (2013.01); *A61G 7/015* (2013.01); *A61G 9/003* (2013.01)

(58) Field of Classification Search
CPC ..... A61G 7/02; A61G 7/015; A61G 7/047; A61G 7/0005; A61G 9/02; A61G 9/003; E03D 9/08
See application file for complete search history.

(56) References Cited

U.S. PATENT DOCUMENTS 3,922,735 A 12/1975 Kato
3,943,583 A 3/1976 Ishikawa
4,183,105 A * 1/1980 Womack ..... E03D 9/005 134/167 R
4,677,700 A 7/1987 Su
5,265,296 A * 11/1993 Abbas ..... A61G 7/02 5/488
5,359,736 A * 11/1994 Olivier ..... E03D 9/08 4/420.2
D375,849 S 11/1996 Conrad
5,604,943 A * 2/1997 Kimura ..... A61G 7/02 5/604
5,685,034 A * 11/1997 Kleer ..... A61G 7/02 5/604
5,842,237 A * 12/1998 Hargest ..... A61G 7/002 4/449
5,926,875 A * 7/1999 Okamoto ..... A61G 7/02 5/604
9,038,215 B2 * 5/2015 Al-Jafar ..... A61G 7/02 5/604
2010/0083441 A1 * 4/2010 Ishida ..... A61G 7/002 5/604

FOREIGN PATENT DOCUMENTS

WO WO2011004142 1/2011

* cited by examiner

*Primary Examiner* — David R Hare
*Assistant Examiner* — Adam C Ortiz

(57) ABSTRACT

A hospital bed assembly includes a bed frame that may be positioned on a support surface. A mattress lies on the bed frame and a user lies on the mattress. The mattress has an opening extending therethrough and the opening is aligned with the user's buttocks when the user lies on the mattress. A toilet unit is movably coupled to the mattress and the toilet unit receives feces and urine from the user. The toilet unit is fluidly coupled to a sewer thereby facilitating the feces and urine to be flushed into the sewer. Moreover, the toilet unit is aligned with the opening in the mattress. A control unit is coupled to the bed frame and the control unit is electrically coupled to the toilet unit to control operational parameters of the toilet unit.

15 Claims, 7 Drawing Sheets

HOSPITAL BED ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to bed devices and more particularly pertains to a new bed device for facilitating a bed ridden individual to defecate and urinate without assistance.

BRIEF SUMMARY OF THE INVENTION

An embodiment of the disclosure meets the needs presented above by generally comprising a bed frame that may be positioned on a support surface. A mattress lies on the bed frame and a user lies on the mattress. The mattress has an opening extending therethrough and the opening is aligned with the user's buttocks when the user lies on the mattress. A toilet unit is movably coupled to the mattress and the toilet unit receives feces and urine from the user. The toilet unit is fluidly coupled to a sewer thereby facilitating the feces and urine to be flushed into the sewer. Moreover, the toilet unit is aligned with the opening in the mattress. A control unit is coupled to the bed frame and the control unit is electrically coupled to the toilet unit to control operational parameters of the toilet unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
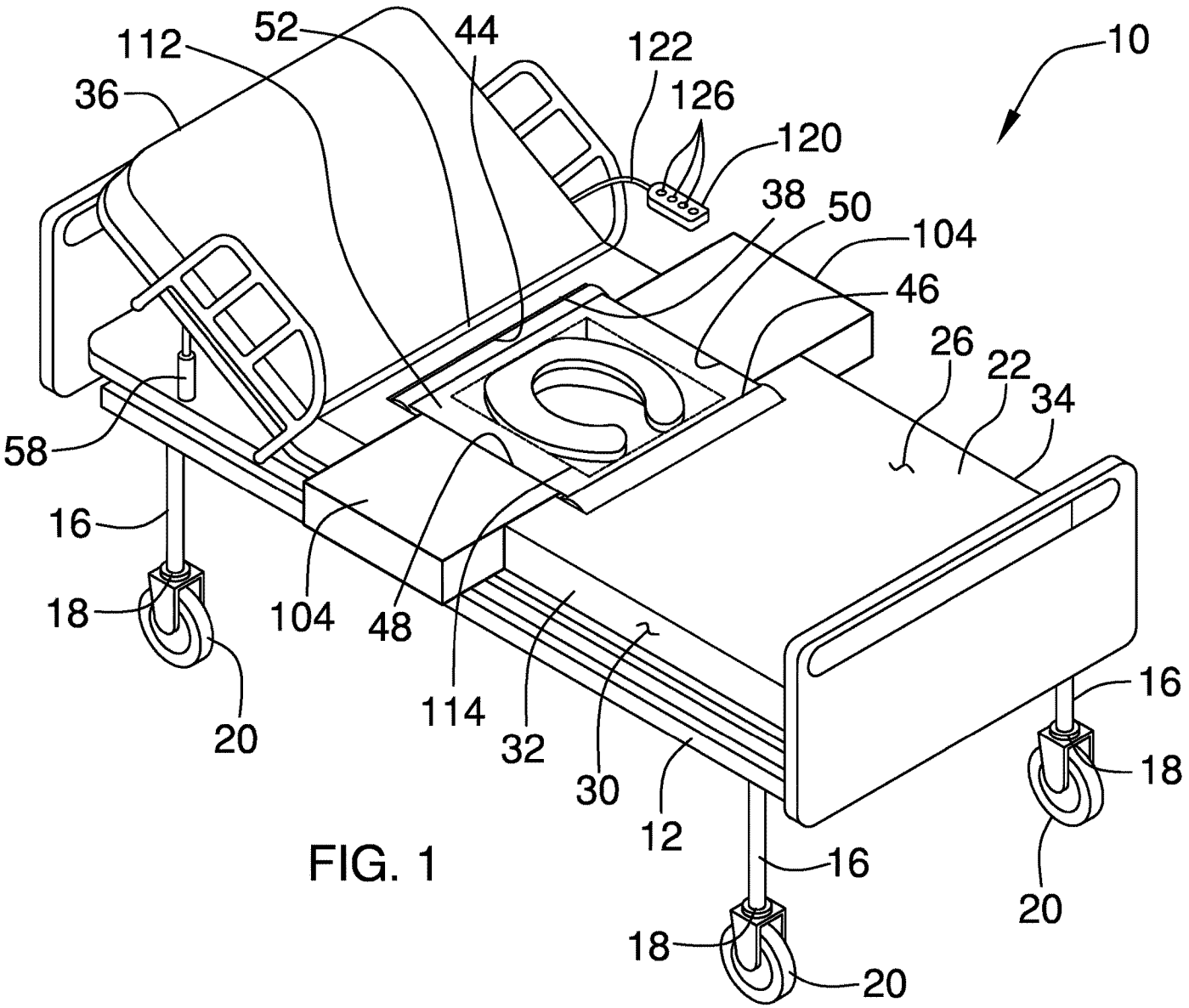
FIG. 1 is a top perspective view of a hospital bed assembly according to an embodiment of the disclosure.
Figure 2:
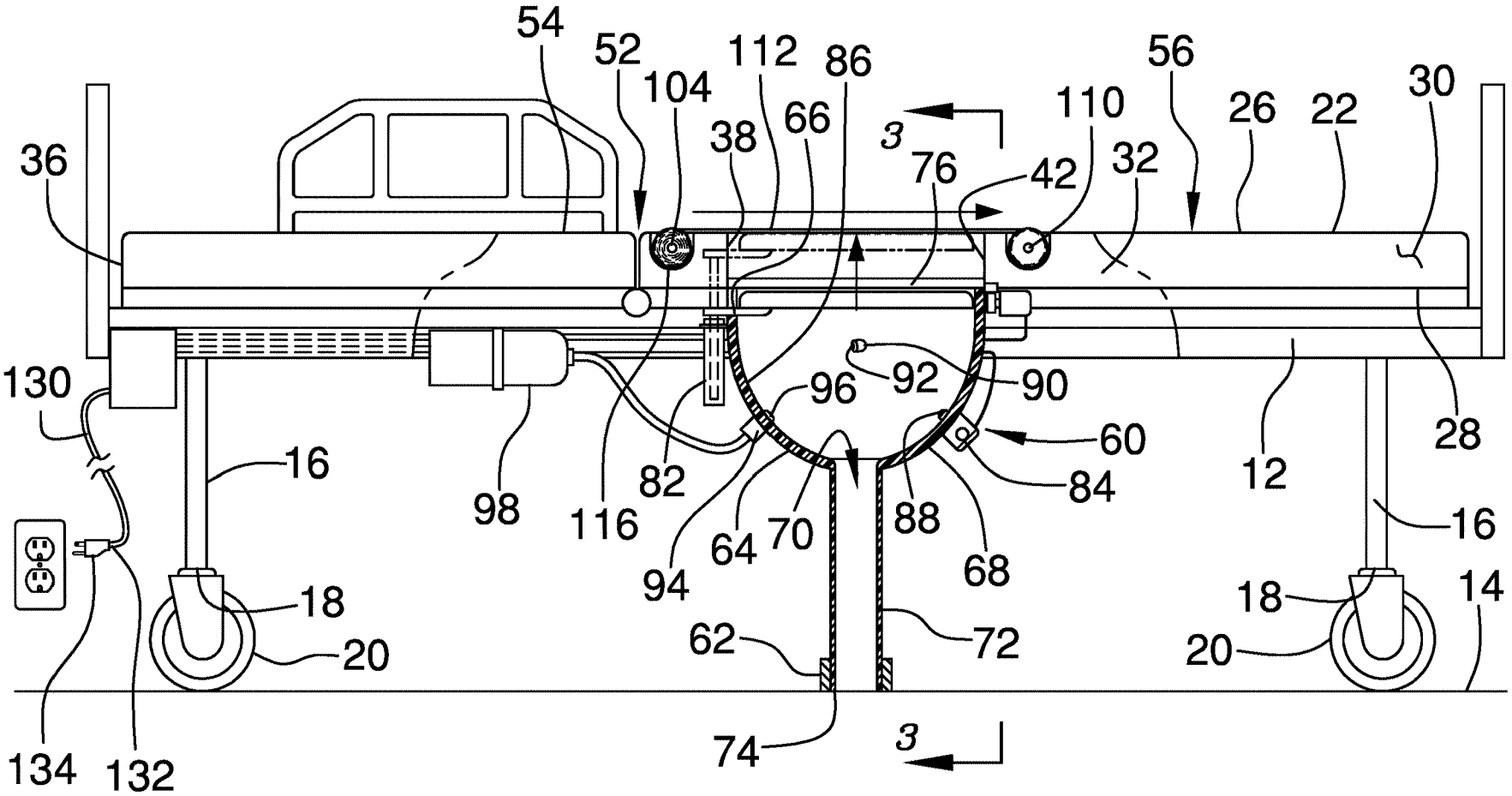
FIG. 2 is a right side cut-away view of an embodiment of the disclosure.
Figure 3:
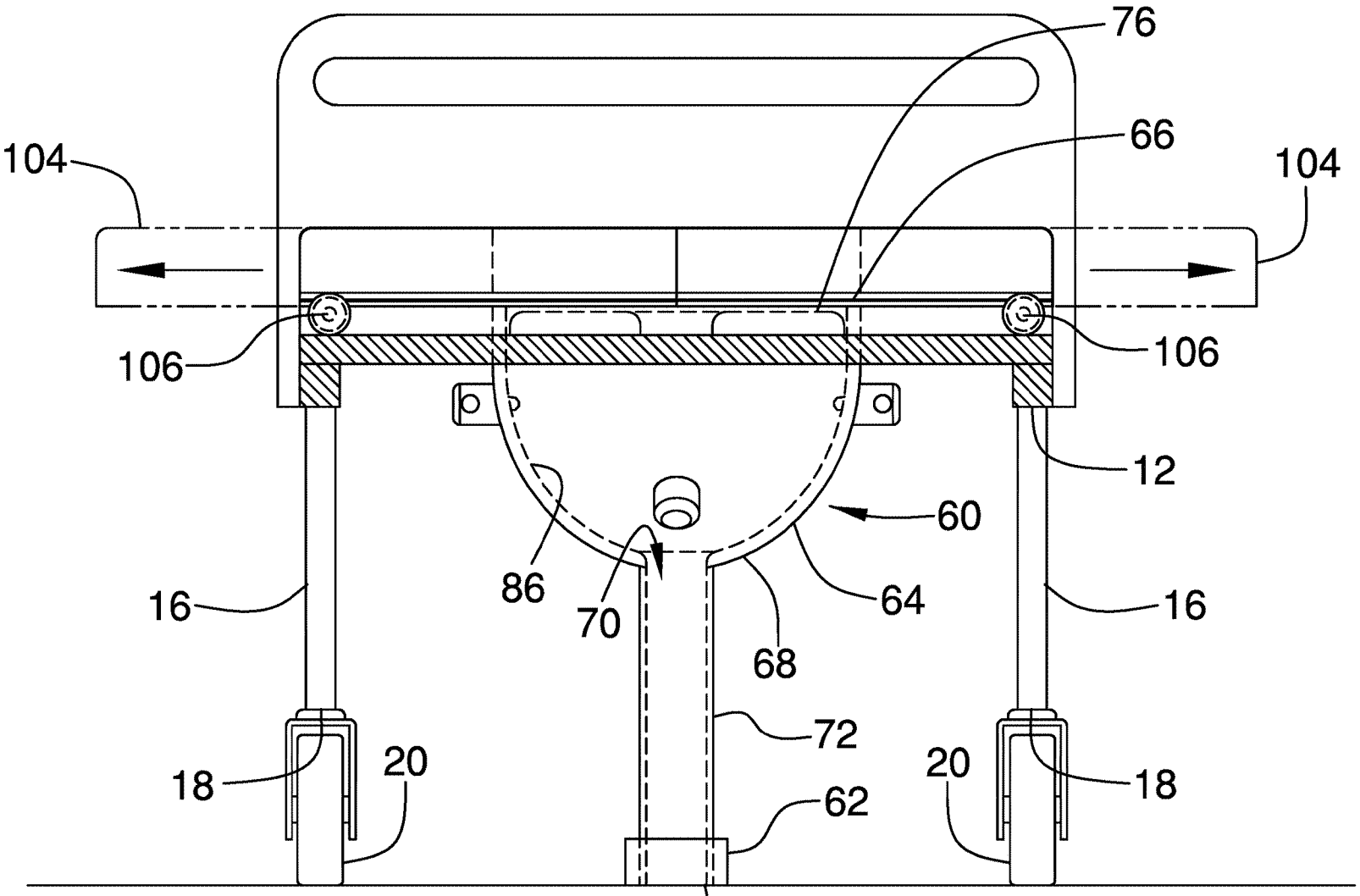
FIG. 3 is a cross sectional view taken along line 3-3 of FIG. 2 of an embodiment of the disclosure.
Figure 4:
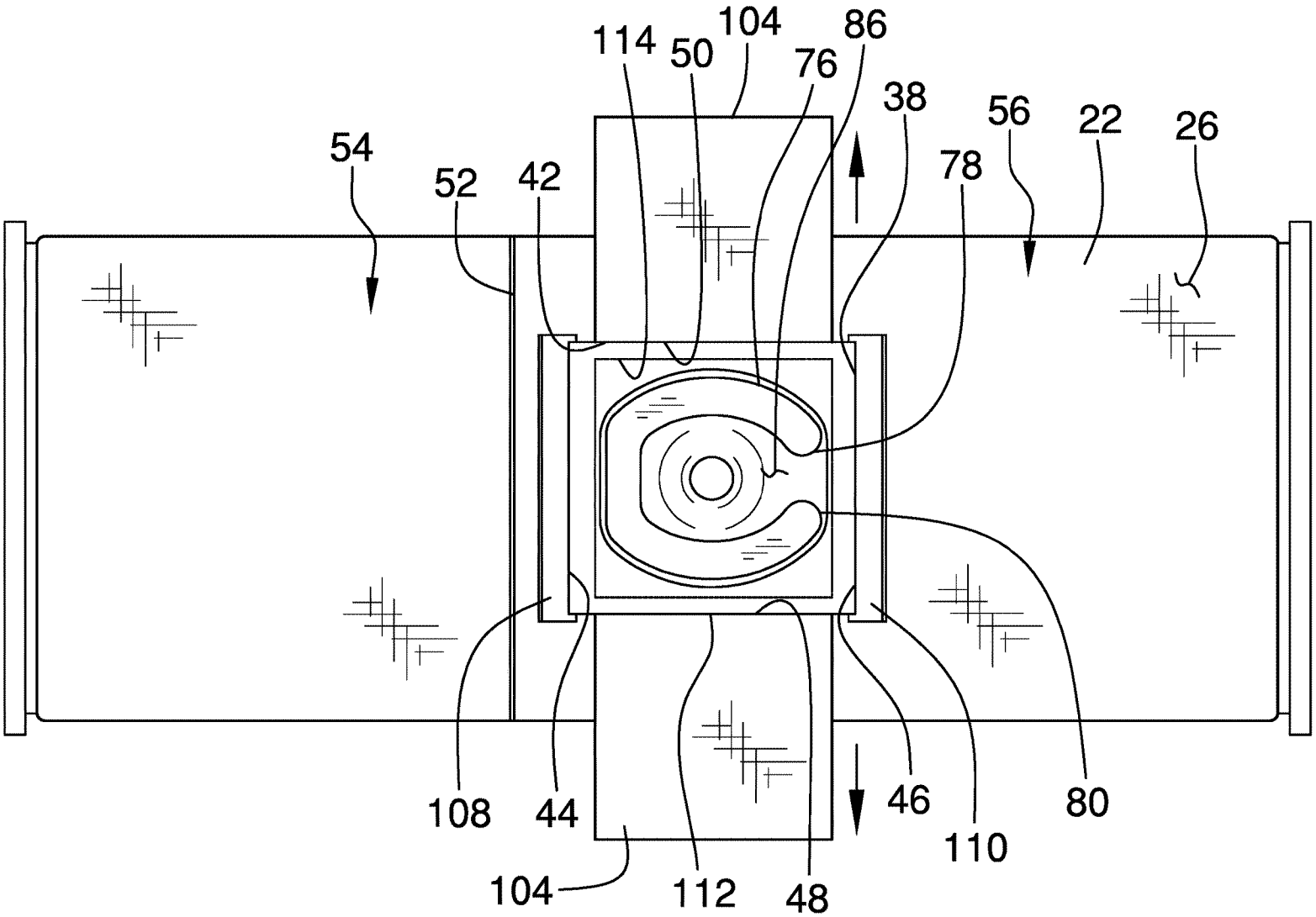
FIG. 4 is a top view of an embodiment of the disclosure.
Figure 5:
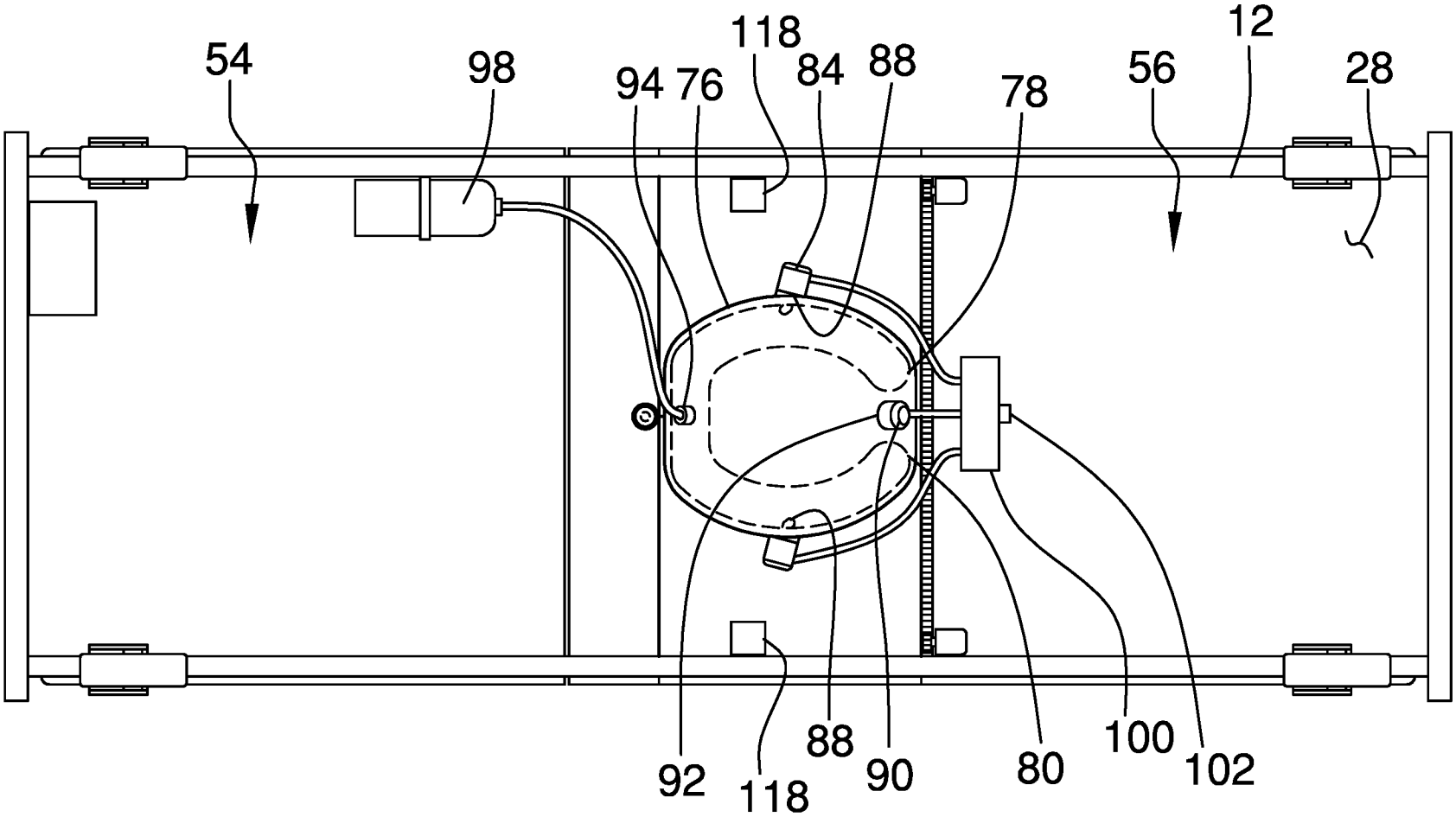
FIG. 5 is a bottom view of an embodiment of the disclosure.
Figure 6:
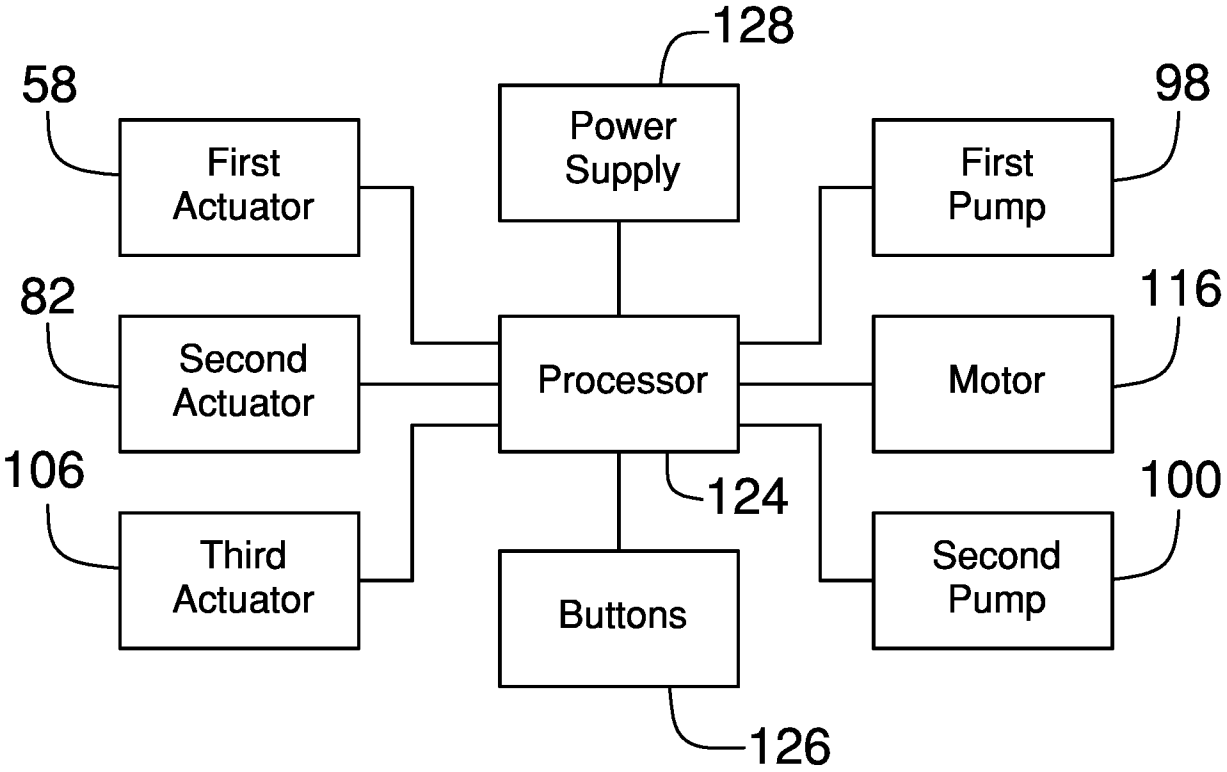
FIG. 6 is a schematic view of an embodiment of the disclosure.
Figure 7:
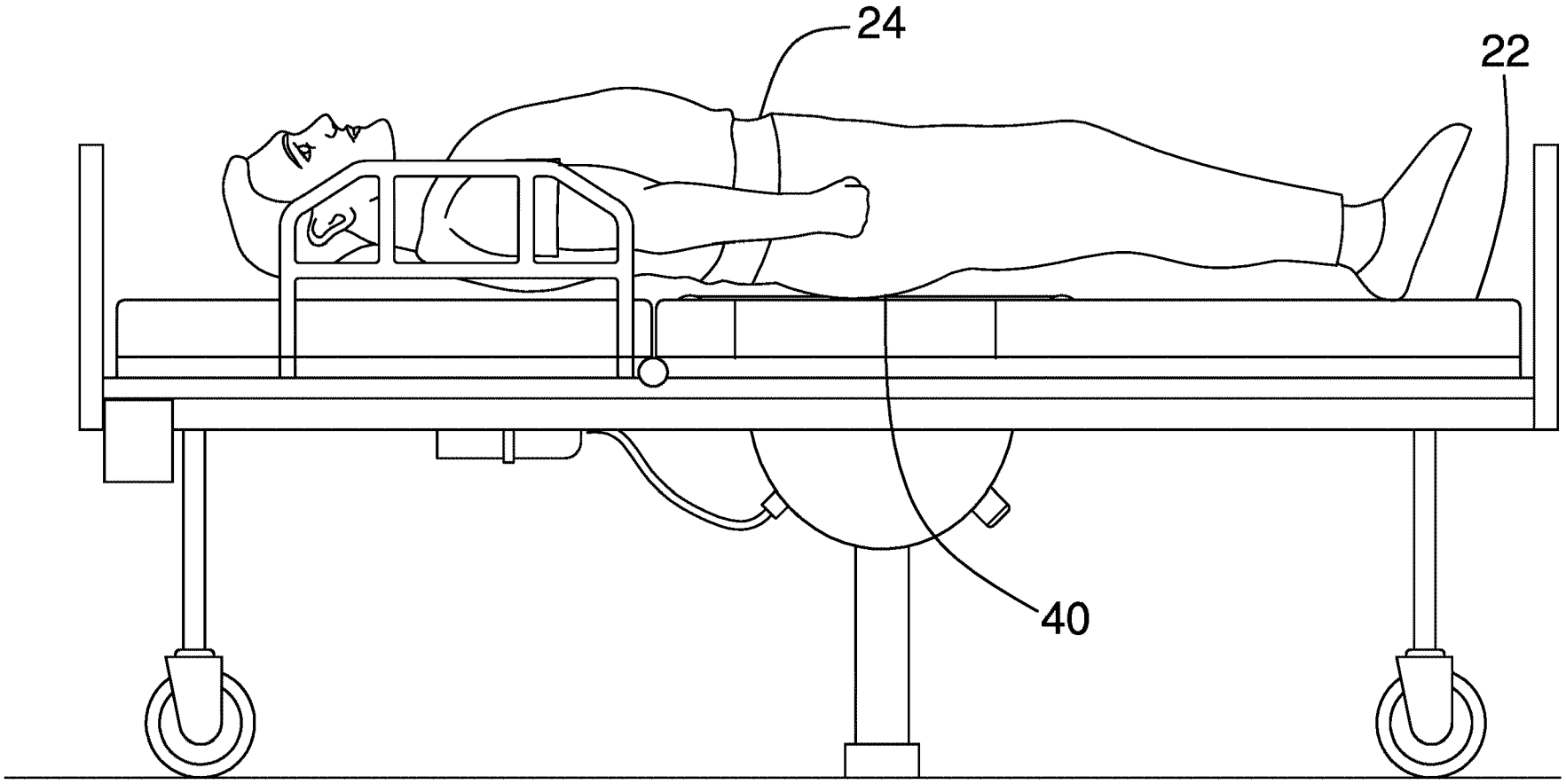
FIG. 7 is a perspective in-use view of an embodiment of the disclosure.

With reference now to the drawings, and in particular to FIGS. 1 through 7 thereof, a new bed device embodying the principles and concepts of an embodiment of the disclosure and generally designated by the reference numeral 10 will be described.

As best illustrated in FIGS. 1 through 7, the hospital bed assembly 10 generally comprises a bed frame 12 that is positioned on a support surface 14 such as a floor or the like. Additionally, the bed frame 12 may be positioned in a medical environment, such a hospital, a nursing home and any other location that houses bedridden people. A plurality of legs 16 is coupled to and extends downwardly from the bed frame 12. Each of the legs 16 has a distal end 18 with respect to the bed frame 12. A plurality of wheels 20 is rotatably coupled to the distal end 18 of an associated one of the legs 16 to roll along the support surface 14.

A mattress 22 lies on the bed frame 12 and a user 24 lies thereon. The mattress 22 has a top surface 26, a bottom surface 28 and a perimeter surface 30 extending therebetween. The perimeter surface 30 has a first lateral side 32, a second lateral side 34 and a front side 36. Moreover, the mattress 22 has an opening 38 extending through the top 26 and bottom 28 surfaces. The opening 38 is centrally positioned on the mattress 22 such that the opening 38 is aligned with the user's buttocks 40 when the user 24 lies on the mattress 22. The opening 38 has a bounding surface 42 and the bounding surface 42 has a forward side 44, a rearward side 46, a first lateral side 48 and a second lateral side 50.

The mattress 22 has a cut 52 extending through the top 26 and bottom 28 surfaces. The cut 52 extends between the first lateral side 32 and the second lateral side 34 of the mattress 22. Thus, the cut 52 defines a first half 54 of the mattress 22 that is hingedly coupled to a second half 56 of the mattress 22. The opening 38 is positioned on the second half 56 and the first half 54 is selectively urged between an inclined position and a flat position. A first actuator 58 is coupled between the bed frame 12 and the mattress 22. The first actuator 58 selectively urges the first half 54 of the mattress 22 to a selected point between the inclined position and the flat position. The first actuator 58 may be an electric piston or the like.

A toilet unit 60 is provided and the toilet unit 60 is movably coupled to the mattress 22 to receive feces and urine from the user 24. The toilet unit 60 is fluidly coupled to a sewer 62 thereby facilitating the feces and urine to be flushed into the sewer 62. The toilet unit 60 is aligned with the opening 38 in the mattress 22. The toilet unit 60 comprises a bowl 64 that has a top edge 66 and a bottom side 68. The bowl 64 is coupled to the bed frame 12 and the top edge 66 is aligned with the opening 38 in the mattress 22. Thus, the bowl 64 receives the feces and urine.

The bottom side 68 has an opening 70 extending therethrough to pass the feces and urine outwardly from the bowl 64. A pipe 72 is fluidly coupled to the bottom side 68 of the bowl 64. The pipe 72 is aligned with the opening 70 in the bowl 64 to transport the feces and urine outwardly from the bowl 64. The pipe 72 has a distal end 74 with respect to the bowl 64 and the distal end 74 of the pipe 72 is fluidly coupled to the sewer 62. The sewer 62 may be a sewer line that is conventional to building construction.

A seat 76 is provided that has a first end 78 and a second end 80. The seat 76 is curved between the first 78 and second 80 ends such that the seat 76 has a horseshoe shape. The seat 76 is aligned with the opening 38 in the mattress 22. Moreover, the seat 76 is positioned on the top edge 66 of the bowl 64. The seat 76 may be a toilet seat of any conventional design.

A second actuator 82 is coupled between the bed frame 12 and the seat 76. The second actuator 82 selectively urges the seat 76 into a lifted position having the seat 76 being spaced from the top edge 66 of the bowl 64. In this way the seat 76 abuts the user's buttocks 40. The second actuator 82 selectively urges the seat 76 into a lowered position having the seat 76 lying on the top edge 66 of the bowl 64. The second actuator 82 may be an electric piston or the like.

A pair of first nozzles 84 is provided and each of the first nozzles 84 is coupled to an inside surface 86 of the bowl 64. Each of the first nozzles 84 has a distal end 88 with respect to the inside surface 86 and the distal end 88 corresponding to each of the first nozzles 84 is open. A second nozzle 90 is coupled to the inside surface 86 of the bowl 64. The second nozzle 90 has a distal end 92 with respect to the inside surface 86 and the distal end of the second nozzle 90 is open. The distal end 92 of the second nozzle 90 is directed toward the top edge 66 of the bowl 64. A third nozzle 94 is coupled to the inside surface 86 of the bowl 64. The third nozzle 94 has a distal end 96 with respect to the bowl 64 and the distal end 96 of the third nozzle 94 is open. The distal end 96 of the third nozzle 94 is directed toward the opening 38.

A first pump 98 is coupled to the bed frame 12 and the first pump 98 is fluidly coupled to the third nozzle 94. The first pump 98 urges air through the third nozzle 94 thereby facilitating the third nozzle 94 to dry the user 24. The first pump 98 may be an electric air pump or the like. A second pump 100 is coupled to the bowl 64 and the second pump 100 is fluidly coupled between each of the first 84 and second 90 nozzles. The second pump 100 may be an electric fluid pump or the like.

The second pump 100 is fluidly coupled to a fluid source 102 thereby facilitating the second pump 100 to selectively urge a fluid outwardly from each of the first 84 and second 90 nozzles. The fluid source 102 may be a water line or the like and the fluid may be water. Each of the first nozzles 84 directs the fluid along the inside surface 86 of the bowl 64 to rinse the feces and urine from the bowl 64. The second nozzle 90 directs the fluid upwardly onto the user's buttocks 40 to rinse the user 24.

A pair of panels 104 is each slidably coupled to the mattress 22. Each of the panels 104 is positioned in a closed position having each of the panels 104 covering the opening 38 in the mattress 22. The user's buttocks 40 lie on the panels 104 when the panels 104 are in the closed position. Each of the panels 104 is positioned in an open position having each of the panels 104 extending outwardly from an associated one of the first 32 and second 34 lateral sides of the mattress 22. Thus, the opening 38 is exposed when the panels 104 are positioned in the open position. Each of the panels 104 may be comprised of a resiliently compressible material to enhance comfort for the user 24. Additionally, each of the panels 104 may be comprised of a fluid impermeable material.

A pair of third actuators 106 is provided and each of the third actuators 106 is coupled to the bed frame 12. Each of the third actuators 106 is mechanically coupled to an associated one of the panels 104. Moreover, each of the third actuators 106 selectively urges the associated panel 104 between the open position and the closed position. Each of the third actuators 106 may comprise an electric rack and pinion actuator or the like.

A first roller 108 is rotatably coupled to the mattress 22 and the first roller 108 is aligned with the forward side 44 of the opening 38 in the mattress 22. A second roller 110 is rotatably coupled to the mattress 22 and the second roller 110 is aligned with the rearward side 46 of the opening 38 in the mattress 22. A sheet 112 is rolled around the first roller 108 and the second roller 110 such that the sheet 112 extends across the opening 38. The sheet 112 has a plurality of removable sections 114. The removable sections 114 are spaced apart from each other and are distributed along an entire length of the sheet 112. The sheet 112 may be perforated around each of the removable sections 114 thereby facilitating the removable sections 114 to be selectively torn away from the sheet 112. The sheet 112 may be comprised of a fluid absorbent material or the like.

A motor 116 is coupled to the first roller 108 such that the motor 116 selectively rolls the sheet 112 across the opening 38. The motor 116 sequentially positions each of the removable sections 114 over the opening 38. Each of the panels 104 frictionally engages the removable section that is positioned over the opening 38 when the panels 104 are urged into the open position. Thus, the removable section 114 that is positioned over the opening 38 falls into the bowl 64 to facilitate the feces and urine to fall into the bowl 64. The motor 116 may be an electric motor 116 or the like.

A pair of fourth actuators 118 is provided and each of the fourth actuators 118 is coupled between the bed frame 12 and the bottom surface 28 of the mattress 22. Each of the fourth actuators 118 is aligned with an associated one of the first 32 and second 34 lateral sides of the mattress 22. Each of the fourth actuators 118 selectively urges the mattress 22 into a first tilted position having the first lateral side 32 of the mattress 22 being elevated from the bed frame 12. In this way each of the fourth actuators 118 may urge the user 24 to roll onto the user 24's left side thereby inhibiting bed sores from developing.

Each of the fourth actuators 118 selectively urges the mattress 22 into a second tilted position having the second lateral side 34 of the mattress 22 being elevated from the bed frame 12. Thus, each of the fourth actuators 118 urges the user 24 to roll onto the user 24's right side thereby inhibiting bed sores from developing. Each of the fourth actuators 118 selectively urges the mattress 22 to lie flat on the bed frame 12. Moreover, each of the fourth actuators 118 may be an electric piston or the like.

A control unit 120 is coupled to the bed frame 12 and the control unit 120 selectively manipulated. The control unit 120 is electrically coupled to the toilet unit 60, the first actuator 58, the motor 116, each of the third actuators 106 and each of the fourth actuators 118. Thus, the control unit 120 controls operational parameters of the toilet unit 60, the first actuator 58, the motor 116, each of the third actuators 106 and each of the fourth actuators 118. The control unit 120 comprises a housing 121 that is selectively manipulated.

A plurality of conductors 122 extends outwardly from the housing 121. Each of the conductors 122 is electrically coupled to an associated one of the first actuator 58, the first pump 98, the second pump 100, the second actuators 82, the motor 116, the third actuators 106 and the fourth actuators 118. A processor 124 is positioned within the housing 121 and the processor 124 is electrically coupled to each of the conductors 122. The processor 124 may be an electronic processor 124 or the like. The processor 124 may selectively generate a tilting sequence. Thus, the processor 124 actuates the fourth actuators 118 to slowly urge the mattress 22 into the first tilted position, the second tilted position and the flat position such that the user 24 does not notice the motion of the mattress 22. In this way the user 24 is continually repositioned to inhibit the development of bedsores without intervention from a caregiver.

A plurality of buttons 126 is provided and each of the buttons 126 is movably coupled to the housing 121 and each of the buttons 126 is selectively manipulated. Each of the buttons 126 is electrically coupled to the processor 124. Moreover, each of the buttons 126 controls operational parameters of an associated one of the first actuator 58, the first pump 98, the second pump 100, the second actuator 82*s*, the motor 116, the third actuators 106 and the fourth actuators 118.

The plurality of buttons 126 may include an open button to urge the panels 104 into the open position and a close button to urge the panels 104 into the closed position. The plurality of buttons 126 may include an incline button and a decline button to position the first half 54 of the mattress 22 between the inclined position and the flat position. Additionally, the plurality of buttons 126 may include an up button and down button for lifting and lowering the seat 76. The plurality of buttons 126 may include an advance button to actuate the motor 116 to roll a removable section of the sheet 112 over the opening 38. The plurality of buttons 126 may include a dry button to turn on the first pump 98 and a flush button to turn on the second pump 100.

A power supply 128 is coupled to the housing 121 and the power supply 128 is electrically coupled to the processor 124. The power supply 128 comprising a power cord 130 has a distal end 132 with respect to the housing 121. A plug 134 is electrically coupled to the distal end 132 of the power cord 130 and the plug 134 is electrically coupled to a power source such as an electrical outlet or the like.

In use, the user 24 lies on the bed for recovery from surgery, convalescence and any other medical purpose. The control unit 120 is manipulated to selectively urge each of the panels 104 into the open position and the control unit 120 is manipulated to lift the seat 76 upwardly to abut the user 24's buttocks 40. Thus, the user 24 may defecate and urinate without leaving the bed. The control unit 120 is manipulated to turn on the second pump 100 thereby rinsing the user 24's buttocks 40 and flushing the toilet unit 60. The control unit 120 is manipulated to turn on the first pump 98 to dry the user 24's buttocks 40. In this way the user 24 is cleaned when the user 24 has finished defecating and urinating. The control unit 120 is manipulated such the processor 124 generates the tilting sequence. In this way the user 24 is continuously repositioned on the mattress 22 to inhibit the development of bedsores.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hospital bed assembly being configured to facilitate defecation and urination for a bed-ridden user, said assembly comprising:

a bed frame being configured to be positioned on a support surface;

a mattress lying on said bed frame wherein said mattress is configured to have a user lie thereon, said mattress having an opening extending therethrough, wherein said opening is configured to be aligned with the user's buttocks when the user lies on said mattress, said mattress having a top surface, a bottom surface and a perimeter surface extending therebetween, said perimeter surface having a first lateral side, a second lateral side and a front side, said opening extending through said top surface and said bottom surface, said opening having a bounding surface, said bounding surface having a forward side, a rearward side, a first lateral side and a second lateral side, said mattress having a cut extending through said top and bottom surfaces, said cut extending between said first lateral side and said second lateral side of said mattress to define a first half being hingedly coupled to a second half of said mattress, said opening being positioned on said second half, said first half being selectively urged between an inclined position and a flat position;

a toilet unit being movably coupled to said mattress wherein said toilet unit is configured to receive feces and urine from the user, said toilet unit being configured to be fluidly coupled to a sewer thereby facilitating the feces and urine to be flushed into the sewer, said toilet unit being aligned with said opening in said mattress;

a control unit being coupled to said bed frame wherein said control unit is configured to be manipulated, said control unit being electrically coupled to said toilet unit thereby controlling operational parameters of said toilet unit;

a first roller being rotatably coupled to said mattress, said first roller being aligned with said forward side of said opening in said mattress;

a second roller being rotatably coupled to said mattress, said second roller being aligned with said rearward side of said opening in said mattress;

a sheet being rolled around said first roller and said second roller such that said sheet extends across said opening, said sheet having a plurality of removable sections; and a motor being coupled to said first roller such that said motor selectively rolls said sheet across said opening, said motor sequentially positioning each of said removable sections over said opening, each of said panels frictionally engaging said removable section when said panels are urged into said open position such that said removable section falls into said bowl wherein removable sections are configured to facilitate the feces and urine to fall into said toilet.

2. The assembly according to claim 1, wherein said toilet unit comprises:

a bowl having a top edge and a bottom side, said bowl being coupled to said bed frame having said top edge being aligned with said opening in said mattress wherein said bowl is configured to receive the feces and urine, said bottom side having an opening extending therethrough wherein said opening is configured to pass the feces and urine outwardly from said bowl; and a pipe being fluidly coupled to said bottom side of said bowl, said pipe being aligned with said opening in said bowl wherein said pipe is configured to transport the feces and urine outwardly from said bowl, said pipe having a distal end with respect to said bowl, said distal end being configured to be fluidly coupled to the sewer.

3. The assembly according to claim 1, further comprising a seat having a first end and a second end, said seat being curved between said first and second ends such that said seat has a horseshoe shape, said seat being aligned with said opening in said mattress, said seat being positioned on said top edge of said bowl.

4. The assembly according to claim 3, further comprising a first actuator and a second actuator, said second actuator being coupled between said bed frame and said seat, said second actuator selectively urging said seat into a lifted position having said seat being spaced from said top edge of said bowl wherein said seat is configured to abut the user's buttocks, said second actuator selectively urging said seat into a lowered position having said seat lying on said top edge of said bowl.

5. The assembly according to claim 2, further comprising:

a pair of first nozzles, each of said first nozzles being coupled to an inside surface of said bowl, each of said first nozzles having a distal end with respect to said inside surface, said distal end corresponding to each of said first nozzles being open;

a second nozzle being coupled to said inside surface of said bowl, said second nozzle having a distal end with respect to said inside surface, said distal end of said second nozzle being open, said distal end of said second nozzle being directed toward said top edge of said bowl; and a third nozzle being coupled to said inside surface of said bowl, said third nozzle having a distal end with respect to said bowl, said distal end of said third nozzle being open, said distal end of said third nozzle being directed toward said opening.

6. The assembly according to claim 5, further comprising a first pump and a second pump, said second pump being coupled to said bowl, said second pump being fluidly coupled between each of said first and second nozzles, said second pump being configured to be fluidly coupled to a fluid source thereby facilitating said second pump to selectively urge a fluid outwardly from each of said first and second nozzles, each of said first nozzles directing the fluid along said inside surface of said bowl wherein each of said first nozzles is configured to rinse the feces and urine from said bowl, said second nozzle directing the fluid upwardly onto the user's buttocks wherein said second nozzle is configured to rinse the user.

7. The assembly according to claim 1, further comprising a pair of panels, each of said panels being slidably coupled to said mattress, each of said panels being positioned in a closed position having each of said panels covering said opening in said mattress wherein each of said panels is configured to have the user's buttocks lie thereon, each of said panels being positioned in an open position having each of said panels extending outwardly from an associated one of said first and second lateral sides of said mattress such that said opening is exposed.

8. The assembly according to claim 7, further comprising a first actuator, a second actuator, and a pair of third actuators, each of said third actuators being coupled to said bed frame, each of said third actuators being mechanically coupled to an associated one of said panels, each of said third actuators selectively urging said associated panel between said open position and said closed position.

9. The assembly according to claim 1, further comprising a first actuator, a second actuator, a pair of third actuators, and a pair of fourth actuators, each of said fourth actuators being coupled between said bed frame and said bottom surface of said mattress, each of said fourth actuators being aligned with an associated one of said first and second lateral sides of said mattress.

10. The assembly according to claim 9, wherein:

each of said fourth actuators selectively urges said mattress into a first tilted position having said first lateral side of said mattress being elevated from said bed frame wherein each of said fourth actuators is configured to urge the user to roll onto the user's left side thereby inhibiting bed sores from developing;

each of said fourth actuators selectively urges said mattress into a second tilted position having said second lateral side of said mattress being elevated from said bed frame wherein each of said fourth actuators is configured to urge the user to roll onto the user's right side thereby inhibiting bed sores from developing; and each of said fourth actuators selectively urges said mattress to lie flat on said bed frame.

11. The assembly according to claim 4, further comprising:

a first pump;

a second pump;

a plurality of third actuators;

a plurality of fourth actuators; and said control unit including:

a housing being configured to be manipulated; and a plurality of conductors extending outwardly from said housing, each of said conductors being electrically coupled to an associated one of said first actuator, said first pump, said second pump, said second actuators, said motor, said third actuators and said fourth actuators.

12. The assembly according to claim 11, further comprising a processor being positioned within said housing, said processor being electrically coupled to each of said conductors.

13. The assembly according to claim 12, further comprising a plurality of buttons, each of said buttons being movably coupled to said housing wherein each of said buttons is configured to be manipulated, each of said buttons being electrically coupled to said processor such that each of said buttons controls operational parameters of an associated one of said first actuator, said first pump, said second pump, said second actuators, said motor and said third actuators.

14. The assembly according to claim 13, further comprising a power supply being coupled to said housing, said power supply being electrically coupled to said processor, said power supply comprising a power cord having a distal end with respect to said housing, said distal end having a plug being electrically coupled thereto, said plug being configured to be electrically coupled to a power source.

15. A hospital bed assembly being configured to facilitate defecation and urination for a bed-ridden user, said assembly comprising:

a bed frame being configured to be positioned on a support surface;

a plurality of legs, each of said legs being coupled to and extending downwardly from said bed frame, each of said legs having a distal end with respect to said bed frame;

a plurality of wheels, each of said wheels being rotatably coupled to said distal end of an associated one of said legs wherein each of said wheels is configured to roll along the support surface;

a mattress lying on said bed frame wherein said mattress is configured to have a user lie thereon, said mattress having a top surface, a bottom surface and a perimeter surface extending therebetween, said perimeter surface having a first lateral side, a second lateral side and a front side, said mattress having an opening extending through said top and bottom surfaces, said opening being centrally positioned on said mattress wherein said opening is configured to be aligned with the user's buttocks when the user lies on said mattress, said opening having a bounding surface, said bounding surface having a forward side, a rearward side, a first lateral side and a second lateral side, said mattress having a cut extending through said top and bottom surfaces, said cut extending between said first lateral side and said second lateral side of said mattress to define a first half being hingedly coupled to a second half of said mattress, said opening being positioned on said second half, said first half being selectively urged between an inclined position and a flat position;

a first actuator being coupled between said frame and said mattress, said first actuator selectively urging said first half of said mattress at a selected point between said inclined position and said flat position;

a toilet unit being movably coupled to said mattress wherein said toilet unit is configured to receive feces and urine from the user, said toilet unit being configured to be fluidly coupled to a sewer thereby facilitating the feces and urine to be flushed into the sewer, said toilet unit being aligned with said opening in said mattress, said toilet unit comprising:

a bowl having a top edge and a bottom side, said bowl being coupled to said bed frame having said top edge being aligned with said opening in said mattress wherein said bowl is configured to receive the feces and urine, said bottom side having an opening extending therethrough wherein said opening is configured to pass the feces and urine outwardly from said bowl, a pipe being fluidly coupled to said bottom side of said bowl, said pipe being aligned with said opening in said bowl wherein said pipe is configured to transport the feces and urine outwardly from said bowl, said pipe having a distal end with respect to said bowl, said distal end being configured to be fluidly coupled to the sewer, a seat having a first end and a second end, said seat being curved between said first and second ends such that said seat has a horseshoe shape, said seat being aligned with said opening in said mattress, said seat being positioned on said top edge of said bowl, a second actuator being coupled between said bed frame and said seat, said second actuator selectively urging said seat into a lifted position having said seat being spaced from said top edge of said bowl wherein said seat is configured to abut the user's buttocks, said second actuator selectively urging said seat into a lowered position having said seat lying on said top edge of said bowl, a pair of first nozzles, each of said first nozzles being coupled to an inside surface of said bowl, each of said first nozzles having a distal end with respect to said inside surface, said distal end corresponding to each of said first nozzles being open, a second nozzle being coupled to said inside surface of said bowl, said second nozzle having a distal end with respect to said inside surface, said distal end of said second nozzle being open, said distal end of said second nozzle being directed toward said top edge of said bowl, a third nozzle being coupled to said inside surface of said bowl, said third nozzle having a distal end with respect to said bowl, said distal end of said third nozzle being open, said distal end of said third nozzle being directed toward said opening, a first pump being coupled to said bed frame, said first pump being fluidly coupled to said third nozzle wherein said first pump is configured to urge air through said third nozzle thereby facilitating said third nozzle to dry the user, and a second pump being coupled to said bowl, said second pump being fluidly coupled between each of said first and second nozzles, said second pump being configured to be fluidly coupled to a fluid source thereby facilitating said second pump to selectively urge a fluid outwardly from each of said first and second nozzles, each of said first nozzles directing the fluid along said inside surface of said bowl wherein each of said first nozzles is configured to rinse the feces and urine from said bowl, said second nozzle directing the fluid upwardly onto the user's buttocks wherein said second nozzle is configured to rinse the user;

a pair of panels, each of said panels being slidably coupled to said mattress, each of said panels being positioned in a closed position having each of said panels covering said opening in said mattress wherein each of said panels is configured to have the user's buttocks lie thereon, each of said panels being positioned in an open position having each of said panels extending outwardly from an associated one of said first and second lateral sides of said mattress such that said opening is exposed;

a pair of third actuators, each of said third actuators being coupled to said bed frame, each of said third actuators being mechanically coupled to an associated one of said panels, each of said third actuators selectively urging said associated panel between said open position and said closed position;

a first roller being rotatably coupled to said mattress, said first roller being aligned with said forward side of said opening in said mattress;

a second roller being rotatably coupled to said mattress, said second roller being aligned with said rearward side of said opening in said mattress;

a sheet being rolled around said first roller and said second roller such that said sheet extends across said opening, said sheet having a plurality of removable sections;

a motor being coupled to said first roller such that said motor selectively rolls said sheet across said opening, said motor sequentially positioning each of said removable sections over said opening, each of said panels frictionally engaging said removable section when said panels are urged into said open position such that said removable section falls into said bowl wherein removable sections are configured to facilitate the feces and urine to fall into said toilet;

a pair of fourth actuators, each of said fourth actuators being coupled between said bed frame and said bottom surface of said mattress, each of said fourth actuators being aligned with an associated one of said first and second lateral sides of said mattress, each of said fourth actuators selectively urging said mattress into a first tilted position having said first lateral side of said mattress being elevated from said bed frame wherein each of said fourth actuators is configured to urge the user to roll onto the user's left side thereby inhibiting bed sores from developing, each of said fourth actuators selectively urging said mattress into a second tilted position having said second lateral side of said mattress being elevated from said bed frame wherein each of said fourth actuators is configured to urge the user to roll onto the user's right side thereby inhibiting bed sores from developing, each of said fourth actuators selectively urging said mattress to lie flat on said bed frame; and a control unit being coupled to said bed frame wherein said control unit is configured to be manipulated, said control unit being electrically coupled to said toilet unit, said first actuator, said motor and each of said third actuators thereby controlling operational parameters of said toilet unit, said first actuator, said motor, each of said third actuators and each of said fourth actuators, said control unit comprising:

a housing being configured to be manipulated, a plurality of conductors extending outwardly from said housing, each of said conductors being electrically coupled to an associated one of said first actuator, said first pump, said second pump, said second actuators, said motor, said third actuators and said fourth actuators, a processor being positioned within said housing, said processor being electrically coupled to each of said conductors, a plurality of buttons, each of said buttons being movably coupled to said housing wherein each of said buttons is configured to be manipulated, each of said buttons being electrically coupled to said processor such that each of said buttons controls operational parameters of an associated one of said first actuator, said first pump, said second pump, said second actuators, said motor, said third actuators and said fourth actuators, and a power supply being coupled to said housing, said power supply being electrically coupled to said processor, said power supply comprising a power cord having a distal end with respect to said housing, said distal end having a plug being electrically coupled thereto, said plug being configured to be electrically coupled to a power source.

* * * * *